US010974270B1

(12) United States Patent
Huang

(10) Patent No.: US 10,974,270 B1
(45) Date of Patent: Apr. 13, 2021

(54) RAISING DEVICE FOR A HANDLE OF ELECTRIC PAINT GUN

(71) Applicant: Sheng-Hui Huang, New Taipei (TW)

(72) Inventor: Sheng-Hui Huang, New Taipei (TW)

( * ) Notice: Subject to any disclaimer, the term of this patent is extended or adjusted under 35 U.S.C. 154(b) by 0 days.

(21) Appl. No.: 16/913,802

(22) Filed: Jun. 26, 2020

(51) Int. Cl.
*B05B 11/00* (2006.01)
*B05B 15/63* (2018.01)
*B44D 3/14* (2006.01)

(52) U.S. Cl.
CPC ..... *B05B 15/63* (2018.02); *B05B 11/0037* (2013.01); *B44D 3/14* (2013.01)

(58) Field of Classification Search
CPC ..... B05B 15/63; B05B 11/0037; B44D 3/14
See application file for complete search history.

(56) References Cited

U.S. PATENT DOCUMENTS 3,880,356 A * 4/1975 Chandler ..... B05B 9/0833 239/308
5,667,144 A * 9/1997 Snetting ..... B05B 1/3436 239/491
6,390,336 B1 * 5/2002 Orozco ..... B65D 83/203 222/162
7,731,104 B2 * 6/2010 Peterson ..... B05B 7/1413 239/279
9,358,565 B1 * 6/2016 Mizioch ..... B05B 15/622
10,293,351 B2 * 5/2019 Krayer ..... B05B 7/2416
2007/0215721 A1 * 9/2007 Gohring ..... B05B 7/2481 239/340
2015/0353243 A1 * 12/2015 Stryker ..... B44D 3/127 222/173
2016/0008832 A1 * 1/2016 Huang ..... B05B 15/30 239/300
2017/0304853 A1 * 10/2017 Krayer ..... B05B 7/2416

* cited by examiner

*Primary Examiner* — Frrederick C Nicolas
(74) *Attorney, Agent, or Firm* — Muncy, Geissler, Olds & Lowe, P.C.

(57) ABSTRACT

A raising device for a handle of electric paint gun, including a handle, a motor hood, a gun barrel, a nozzle, and a container in many kinds of specifications. An upper side of the handle is connected with the horizontal gun barrel as well as the motor hood. An outer end of the gun barrel is the nozzle, a lower side of the nozzle is a push switch, and the container is connected on a lower end in front of the gun barrel, with a guide tube extending into the container. A bottom end of the handle is a raising device which increases or keeps the length of the original handle to adapt the assembly of a container in all kinds of specifications. Therefore, the electric paint gun can be emplaced stably, and one electric paint gun can be applied to the container in many specifications.

5 Claims, 5 Drawing Sheets

RAISING DEVICE FOR A HANDLE OF ELECTRIC PAINT GUN

BACKGROUND OF THE INVENTION a) Field of the Invention

The present invention relates to a raising device for a handle of electric paint gun, and more particularly to a raising device which increases or keeps the length of the original handle to adapt the assembly of a container in all kinds of specifications, and to emplace the electric paint gun stably, so that a consumer does not need to purchase the electric paint guns in many kinds of specifications, with that one electric paint gun can be applied to the container in many specifications.

b) Description of the Prior Art

It is known that a user can use an electric paint gun to paint a wall, ceiling, wood board, metalwork, etc. by oneself. As the electric paint gun is lightweight and can spray quickly, there is no need to use a brush to paste on the wall slowly and laboringly. Therefore, the electric paint gun is very popular. The electric paint gun itself is equipped with an electric motor, without a need to connect a large air compressor externally. The electric motor boosts a gun barrel and then drives paint (cement paint, oil paint, latex paint, varnish) into the gun barrel by the siphoning phenomenon. The paint is sprayed out of a nozzle which is disposed outside the gun barrel. An ordinary electric paint gun is separated into several specifications, including a large container and a small container. The large container can be used to spray the paint in a medium or large area; whereas, the small container is used to modify a tiny area (such as ornament, sample, car). After operating the electric paint gun of large container to spray the paint in a large area, if a user needs to replace the electric paint gun of large container with an electric paint gun of small container to modify a small area, as the handle is not at a same height as the container, the bottoms cannot be even that the electric paint gun cannot be emplaced on the ground stably, following the change in the size of the container of the electric paint gun. Therefore, the electric paint gun of small container should be one specification (short handle), and the electric paint gun of large container should be another specification that all kinds of specifications can be adapted. Accordingly, the burden to the consumer will be increased. In addition, the paint in the bottom of the large container is rarely withdrawn. On the contrary, if a small container is used instead, then the paint in the bottom can be withdrawn easily (as the inner diameter of the small container is small, the paint raises up easily for the same amount of paint, and the paint can be withdrawn to a maximum extent).

SUMMARY OF THE INVENTION

Conventionally, there are many specifications of electric paint gun of large and small container. As the large container and the small container are not interchangeably, vendors will have to manufacture many kinds of specifications and the consumers will be troubled as well.

Accordingly, the present invention discloses a raising device for a handle of electric paint gun, comprising a handle, a motor hood, a gun barrel, a nozzle, and a container in many kinds of specifications. The handle is vertical, and an upper side of the handle is connected with the horizontal gun barrel as well as the motor hood. An outer end of the gun barrel is provided with the nozzle, and a lower side of the gun barrel is provided with a push switch. A tail end of the gun barrel is provided with an adjusting mechanism, and the container is connected on a lower end in front of the gun barrel, whereas a guide tube is extended into the container. In addition, a large container and a small container are available. The present invention is characterized in that a bottom end of the handle is provided with a raising device, the bottom end of the handle can be even with the bottom of a large container when the raising device is expanded, whereas the bottom end of the handle can be even with the bottom of a small container while the raising device is retracted.

A primary object of the present invention is to provide a raising device for a handle of electric paint gun that the raising device increases or keeps the length of the original handle to adapt the assembly of a container in all kinds of specifications, and to emplace the electric paint gun stably, so that the consumer does not need to purchase the electric paint guns in many kinds of specifications, with that one electric paint gun can be applied to the container in many specifications.

Another object of the present invention is to provide a raising device for a handle of electric paint gun that by expanding the raising device, the bottom of the handle can be even with the bottom of a large container, and the electric paint gun can be emplaced stably on the ground or desktop in an upright position.

Still another object of the present invention is to provide a raising device for a handle of electric paint gun that by retracting the raising device, the bottom of the handle can be even with the bottom of a small container, and the electric paint gun can be emplaced stably on the ground or desktop in an upright position, with the paint being withdrawn and depleted easily.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
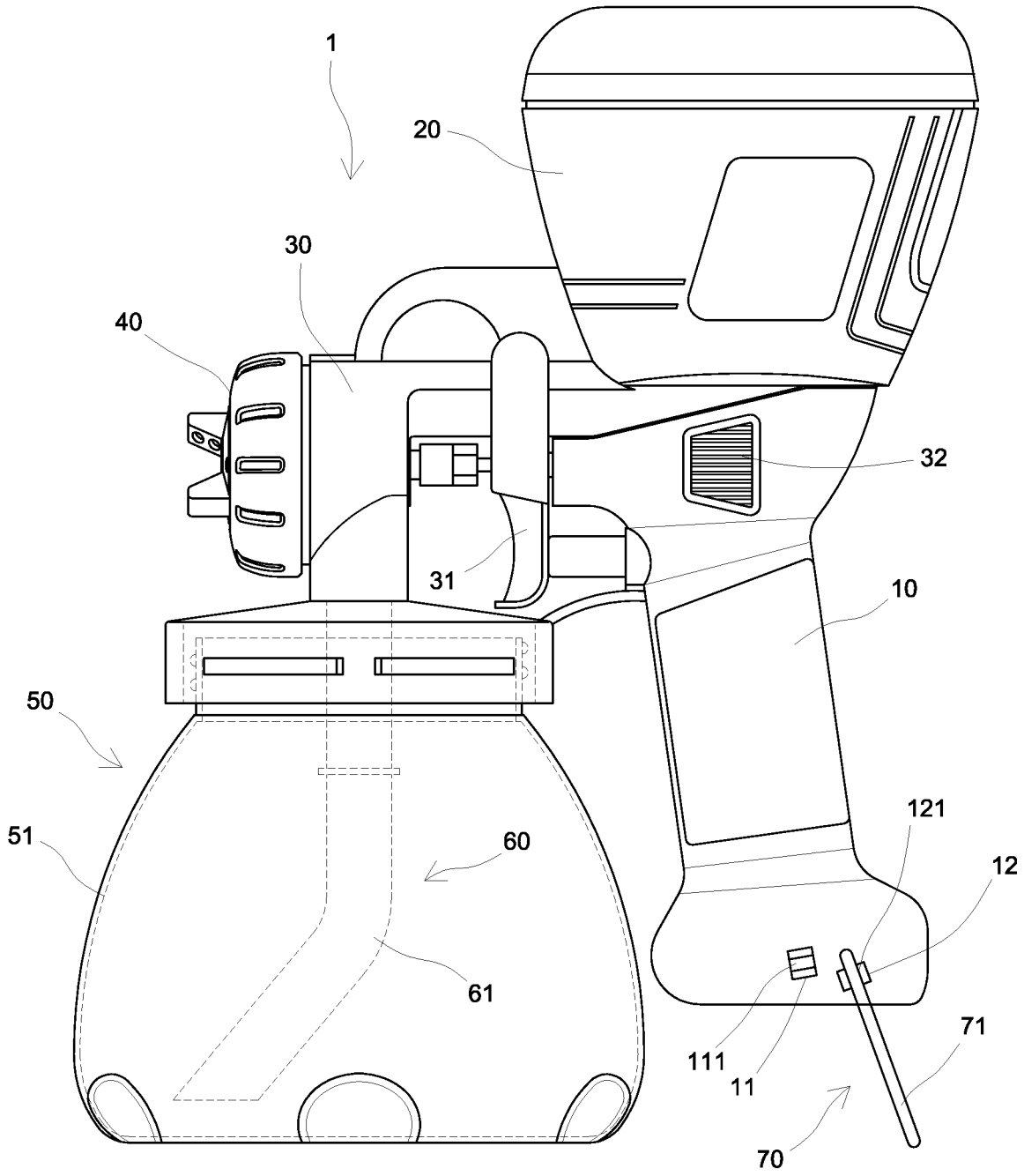
FIG. 1 shows a plan view of the present invention that is applied to a large container.
Figure 2:
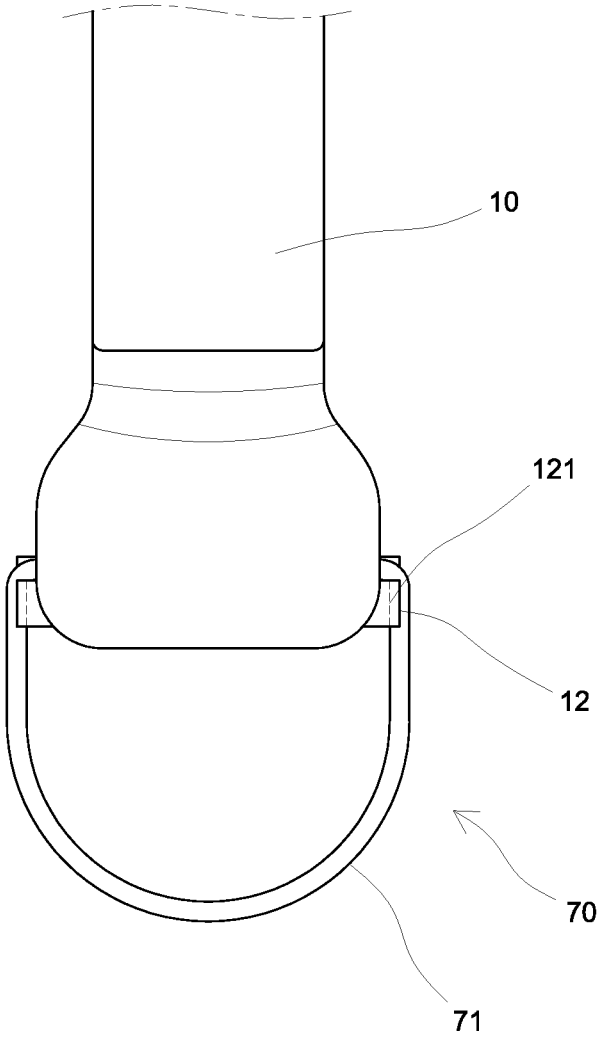
FIG. 2 shows a side view of a handle and a raising device, according to the present invention.
Figure 3:
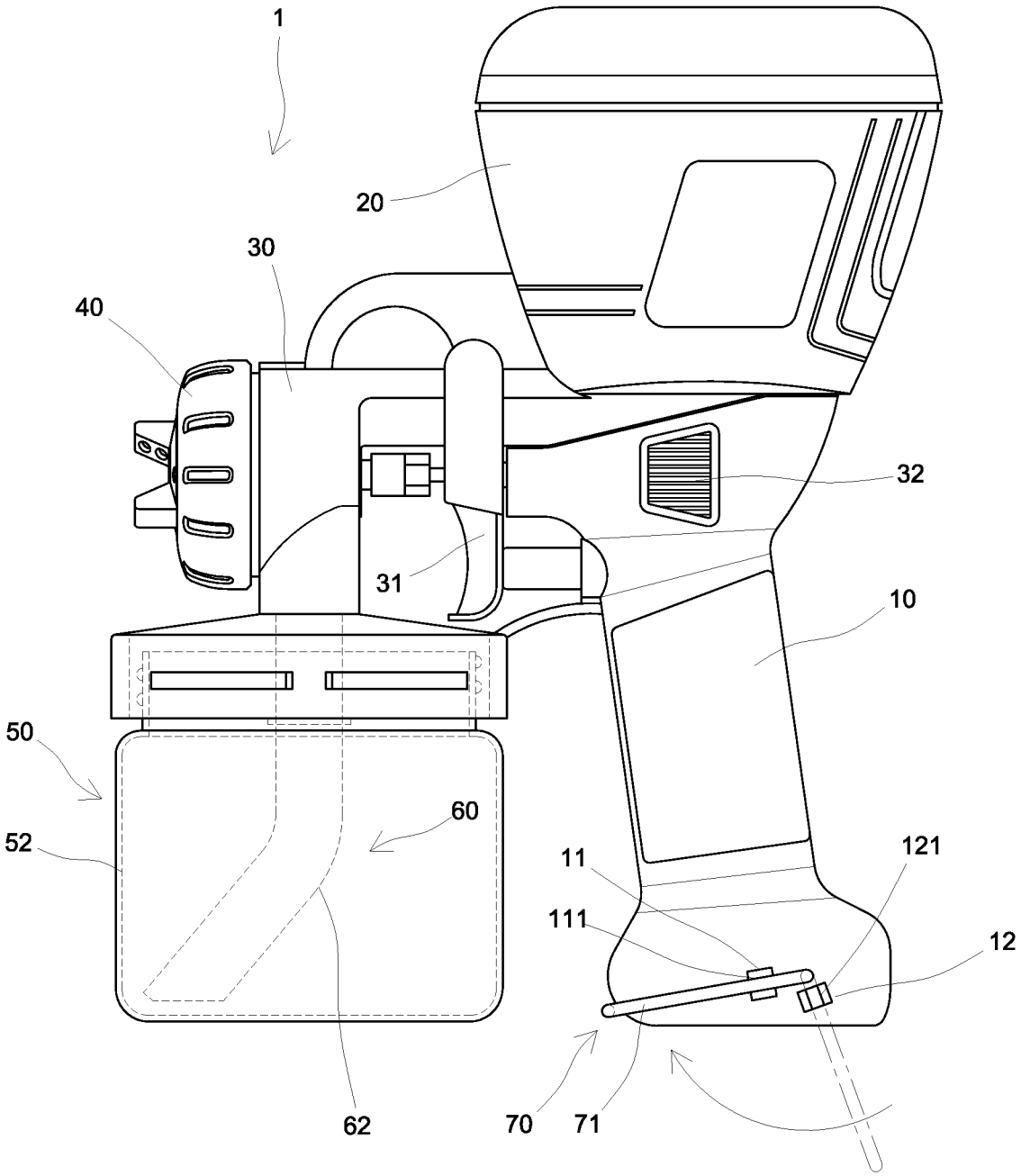
FIG. 3 shows plan view of the present invention that is applied to a small container.
Figure 6:
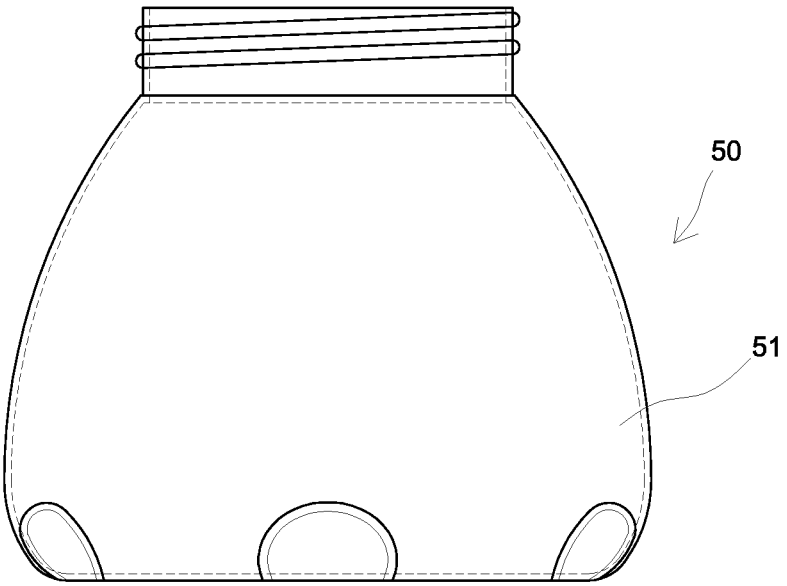
FIG. 6 shows a plan view of large container, according to the present invention.
Figure 7:
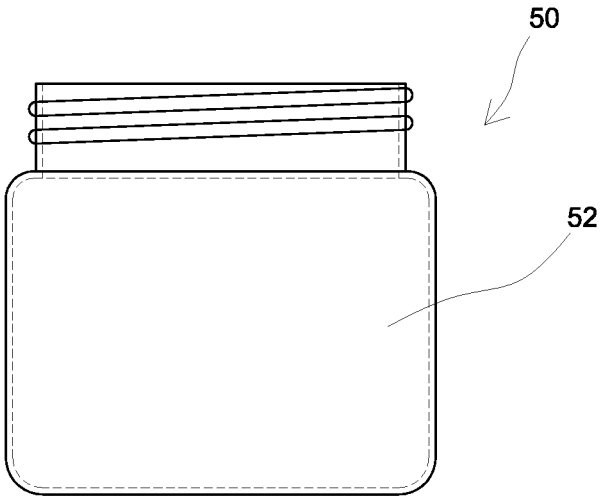
FIG. 7 shows a plan view of small container, according to the present invention.

A raising device for a handle of electric paint gun is disclosed in the present invention. A first embodiment of the present invention is shown in FIGS. 1 to 3, wherein an electric paint gun 1 comprises a handle 10, a motor hood 20, a gun barrel 30, a nozzle 40, and a container 50 in many specifications. The handle 10 is upright and is held by a hand, an upper side of the handle 10 is connected with the horizontal gun barrel 30 as well as the motor hood 20, an outer end of the gun barrel 30 is the nozzle 40, and the nozzle 40 can rotate to adjust the direction of spraying. A lower side of the gun barrel 30 is provided with a push switch 31 which activates a motor (not shown in the drawings) inside the motor hood 20. A tail end of the gun barrel 30 is provided with an adjusting mechanism 32 (power adjustment), the container 50 is connected on a lower end in front of the gun barrel 30, and a guide tube 60 is extended into the container 50. A large container 51 and a small container 52 are available (as shown in FIG. 6 and FIG. 7), and the specifications of connection on the top parts of the large container 51 and the small container 52 are consistent, with that only the volume is different. These containers can be all assembled on a lower end in front of the gun barrel 30. In addition, a bottom end of the handle 10 is provided with a raising device 70 which is a pivot rod 71. The pivot rod 71 is in a U-shape and two sides close to the bottom of the handle 10 are provided respectively with a reset block 11 and an expansion block 12. The expansion block 12 is pivoted to two ends of the pivot rod 71, and is provided with an expansion locating groove 121. The expansion locating groove 121 provides for the latching and positioning of the pivot rod 71. The reset block 11 is provided with a reset groove 111, and the reset groove 111 provides for the latching and positioning of the pivot rod 71, as well. The expansion locating groove 121 and the rest groove 111 are at a different angle of orientation; the expansion locating groove 121 is almost vertical, and the reset groove 111 is horizontal. A long guide tube 61 and a short guide tube 62 are available (as shown in FIG. 1 and FIG. 3); the long guide tube 61 is used for the large container 51, whereas the short guide tube 62 is used for the small container 52.

Figure 4:
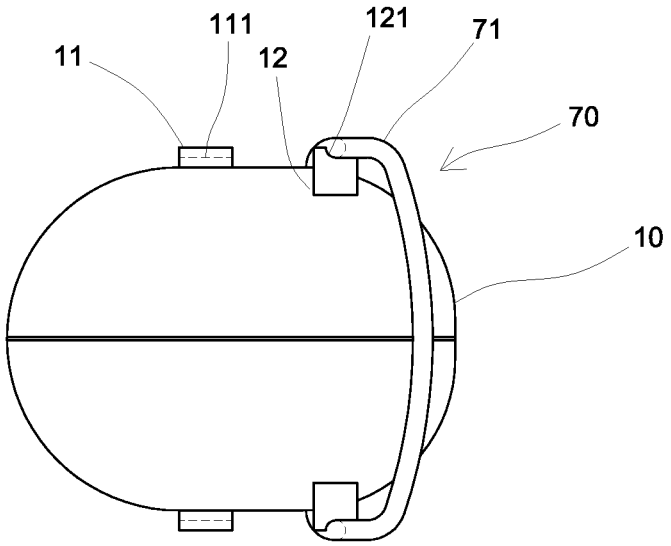
FIG. 4 shows a plan view of the raising device that is expanded, according to the present invention.

By the abovementioned structures, the present invention provides a raising device for a handle of electric paint gun. In using the large container 51 (the long guide tube 61 needs to be assembled), as shown in FIG. 1 and FIG. 4, when the electric paint gun 1 is to be put flat on the ground, the pivot rod 71 of the raising device 70 is expanded and rotates downward, allowing the pivot rod 71 to escape from the reset groove 111. Next, the pivot rod 71 is extended into the expansion locating groove 121 and changes from the horizontal status to the vertical status. In addition, the expansion locating groove 121 can position the pivot rod 71 at the vertical status temporarily to support and raise the handle 10, so that the expanded raising device 70 can be even with the bottom of the large container 51, and the electric paint gun 1 can be put on the ground or desktop in the upright position stably.

Figure 5:
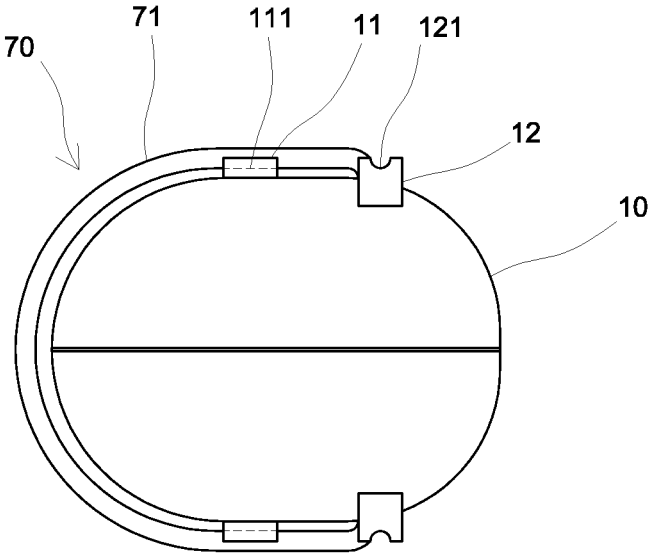
FIG. 5 shows a plan view of the raising device that is retracted, according to the present invention.

To use the small container 52 (the short guide tube 62 needs to be assembled), as shown in FIG. 2, FIG. 3 and FIG. 5, when the electric paint gun 1 is to be put flat on the ground, the pivot rod 71 of the raising device 70 is retracted and rotates upward, allowing the pivot rod 71 to escape from the expansion locating groove 121 to extend into the reset groove 111. Next, the pivot rod 71 changes from the vertical status to the horizontal status, and the reset groove 111 can position the pivot rod 71 at the horizontal and retracted status, so that the bottom of the handle 10 can be even with the bottom of the small container 52, and the electric paint gun 1 can be put on the ground or desktop in the upright position stably. As the inner diameter of the small container 52 is small, the paint can raise up easily for the same amount of the paint, and the paint can be withdrawn and depleted easily to save the paint.

The raising device 70 of the present invention can be manufactured as other means of implementations, and the functions of these equivalent implementations are all within the range of implementation of the present invention.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A raising device for a handle of electric paint horizontal gun, comprising a handle, a motor hood, a gun barrel, a nozzle, and interchangeable containers, wherein the handle is vertical, an upper side of the handle is connected with the horizontal gun barrel as well as the motor hood, an outer end of the horizontal gun barrel is provided with the nozzle, a lower side of the horizontal gun barrel is provided with a push switch, a tail end of the horizontal gun barrel is provided with an adjusting mechanism, one of the interchangeable containers is connected on a lower end in front of the horizontal gun barrel, a guide tube is extended into one of the interchangeable containers, and the interchangeable containers include a large container and a small container, wherein, a bottom end of the handle is provided with a raising device, the raising device is expanded to even the bottom end of the handle with a bottom of the large container, and is retracted to even the bottom end of the handle with a bottom of the small container.

2. The raising device for a handle of electric paint gun, according to claim 1, wherein the raising device is a pivot rod, the pivot rod is in a U-shape, two sides close to the bottom end of the handle are provided respectively with a reset block and an expansion block, the expansion block is pivoted to two ends of the pivot rod and is provided with an expansion locating groove, whereas the reset block is provided with a reset groove.

3. The raising device for a handle of electric paint gun, according to claim 2, wherein the expansion locating groove and the reset groove are at a different angle of orientation, the expansion locating groove is almost vertical, whereas the reset groove is horizontal.

4. The raising device for a handle of electric paint gun, according to claim 1, wherein the guide tube is a long guide tube.

5. The raising device for a handle of electric paint gun, according to claim 1, wherein the guide tube is a short guide tube.

* * * * *